US005807150A

United States Patent [19]

Minter, Sr.

[11] Patent Number: 5,807,150

[45] Date of Patent: Sep. 15, 1998

[54] BLADE SYSTEM FOR MARINE MOTORS

[76] Inventor: Charles F. Minter, Sr., 3236 Lakewood Dr., Shreveport, La. 71107

[21] Appl. No.: 840,173

[22] Filed: Apr. 14, 1997

[51] Int. Cl.[6] ..... B63H 1/28

[52] U.S. Cl. ..... 440/73; 416/146 B

[58] Field of Search ..... 440/73; 416/146 R, 416/146 B

[56] References Cited

U.S. PATENT DOCUMENTS

| | | | |
|---|---|---|---|
| 4,450,670 | 5/1984 | Robinson | 440/73 |
| 5,007,867 | 4/1991 | Kelley | 440/73 |

FOREIGN PATENT DOCUMENTS

| | | | |
|---|---|---|---|
| 164295 | 9/1984 | Japan | 440/73 |

*Primary Examiner*—Jesus D. Sotelo
*Attorney, Agent, or Firm*—John M. Harrison

[57] ABSTRACT

A blade system for mounting on a marine motor such as an electric trolling motor and cutting weeds and other aquatic vegetation that normally entangle the submerged motor and propeller. In a first embodiment the blade system is characterized by a fixed installation in which one or more blades are mounted directly on the motor, or blade mounts are molded or cast into the motor to receive the blades. The blades are typically secured to the motor or blade mounts by bolts and extend toward the propeller, preferably in angular relationship with respect to the longitudinal axis of the motor housing, to cut the aquatic vegetation as the submerged motor operates. In a second embodiment the blade system can be implemented as a retrofit, wherein the blades are bolted or otherwise mounted on the motor or on removable blade mounts secured to the motor by means of one or more hose clamps. The blades are typically secured to the removable blade mounts by means of bolts to position the blades in essentially the same configuration on the motor as in the fixed mount embodiment.

18 Claims, 2 Drawing Sheets

FIG. 1
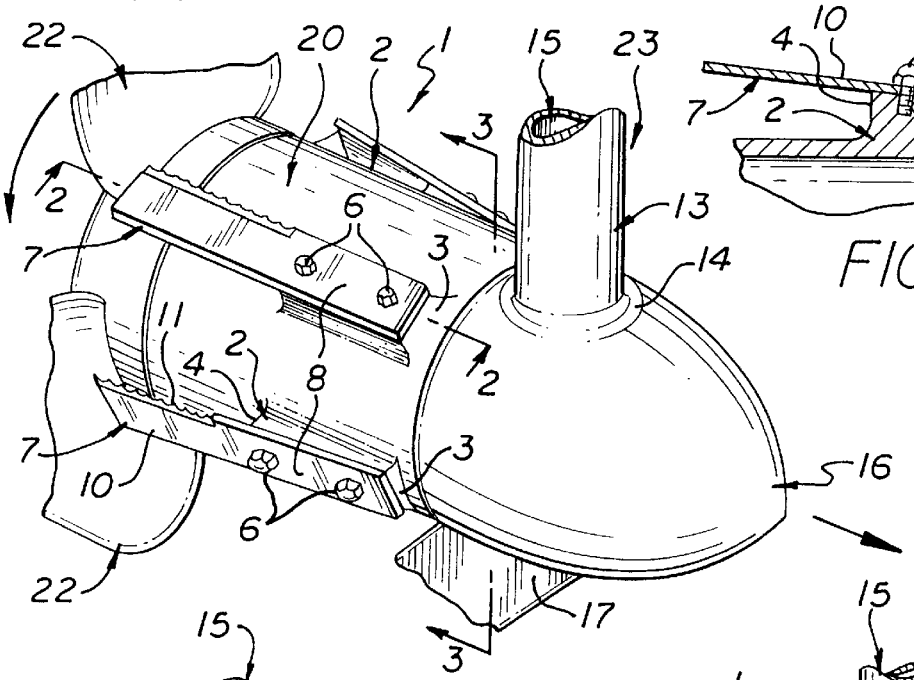
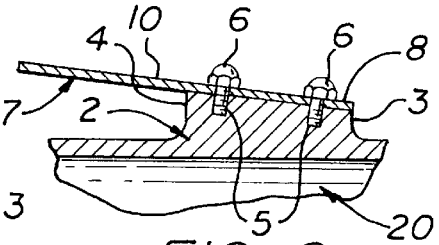
FIG. 2
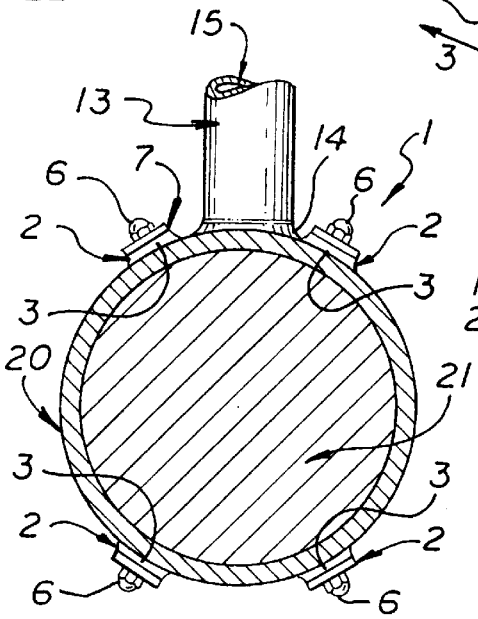
FIG. 3
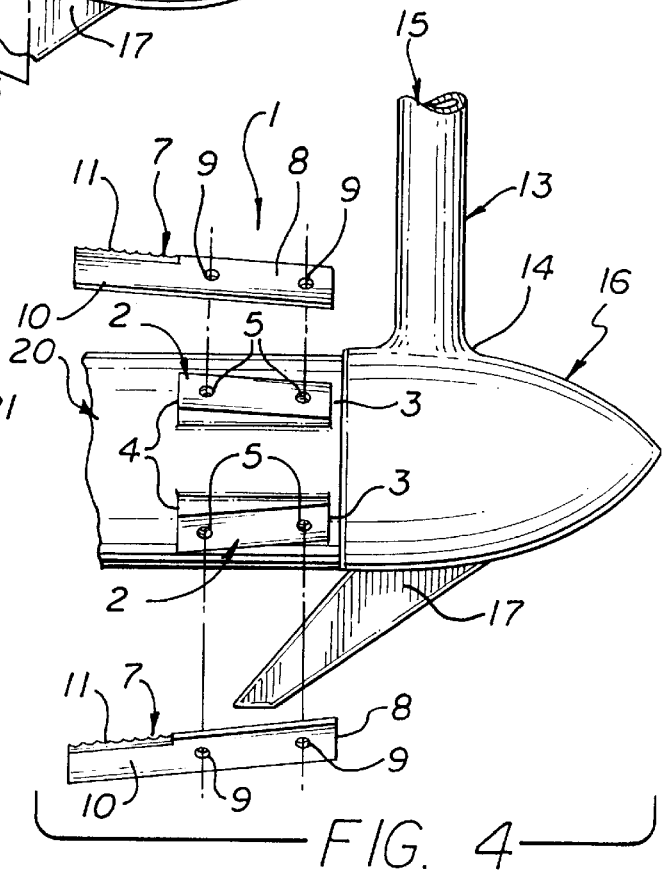
FIG. 4
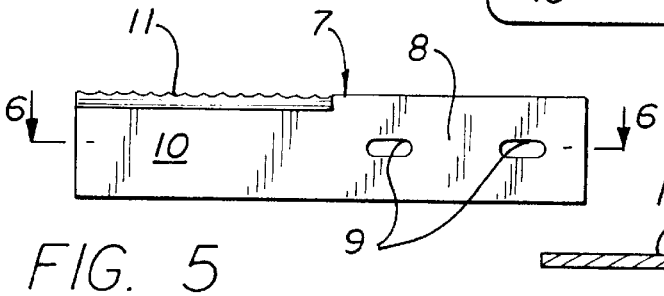
FIG. 5
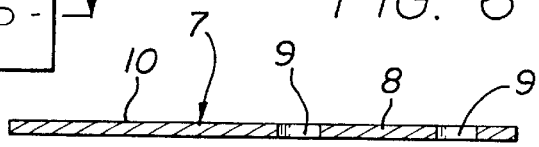
FIG. 6

BLADE SYSTEM FOR MARINE MOTORS

BACKGROUND OF THE INVENTION

FIELD OF THE INVENTION

This invention relates to outboard motors and more particularly, to marine motors such as electric trolling motors fitted with blades to cut submerged weeds, vines, water lily stems and like aquatic vegetation in a waterbody and minimize entanglement of the vegetation on the submerged motor and in the propeller.

One of the problems associated with fishing and boating in various lakes, rivers and other waterways is aquatic vegetation which tends to entangle the propeller and lower propulsion unit of marine outboard motors and especially marine motors of low horsepower, such as electric trolling motors. Among the worst of this entangling aquatic vegetation are water lily stems and submerged hydrilla or moss which grow from the bottom of the waterbody and extend upwardly to the surface of the waterbody in thick patches. The vegetation stems and strands quickly entangle an outboard motor propeller and lower propulsion unit and/or mount shaft by wrapping around the lower propulsion unit or mount shaft and the propeller, thereby requiring stopping of the motor, tilting of the lower propulsion unit upwardly and manually removing the hydrilla or other marine vegetation from the lower propulsion unit or mount shaft, as well as the propeller and propeller shaft. This problem is particularly acute in southern lakes and rivers and other waterbodies where the water tends to be shallow in many areas and is quite troublesome for marine motors such as electric trolling motors, which have limited power and are widely used to propel a boat or watercraft in shallow water at slow speeds during fishing and other shallow water activities.

Accordingly, it is an object of this invention to provide one or more weed cutting blades mounted on the lower propulsion unit of an outboard motor, and particularly an outboard motor of low horsepower such as an electric trolling motor, to cut aquatic vegetation as the motor traverses the vegetation in a lake, river or other waterbody.

Another object of this invention is to provide a new and improved, fixed or removable weed-cutting blade or blades for mounting on the lower propulsion unit of an outboard motor and particularly, the submerged motor housing of an electric trolling motor, and cutting aquatic vegetation as the motor traverses the submerged aquatic vegetation and the propeller forces the aquatic vegetation against the blade or blades.

A still further object of this invention is to provide a blade system for mounting on marine outboard motors such as electric trolling motors, which blade system includes, in a first preferred embodiment, a selected number of removable blocks or tapered ramps or wedges which may be banded or clamped to the submerged propulsion unit of the motor and fitted with preferably serrated blades that extend toward the propeller to cut aquatic vegetation as the lower propulsion unit traverses the vegetation in a lake, river or other waterbody.

In another preferred embodiment of the invention the blade blocks, ramps or wedges may be cast with, or otherwise fixed to the removable segment of a submerged electric motor and the blades attached to the fixed blocks, ramps or wedges by any desired technique.

Yet another object of this invention is to provide a blade system for electric trolling motors, which blade system includes in a first preferred embodiment, multiple fixed blade mount blocks or wedges that are radially spaced on the submerged housing element of the motor and blades fixed to the wedges, which blades extend rearwardly, and preferably radially outwardly, toward the propeller for cutting marine vegetation traversed by the motor and forced across the blades by the propeller, thus preventing, or at least minimizing, entanglement of the marine vegetation on the motor and in the propeller.

SUMMARY OF THE INVENTION

These and other objects of the invention are provided in a new and improved blade system for clearing aquatic vegetation from the propulsion units of marine outboard motors and electric trolling motors in particular, which blade system is characterized in a first preferred embodiment by at least one fixed, substantially rectangular block, or ramp or wedge provided on the submerged lower propulsion unit or electric motor housing of the outboard motor. The wedge-shaped blade mount or mounts have a selected wedge angle for receiving corresponding fixed, preferably serrated knife blades to cut marine vegetation traversed by the submerged propulsion unit. In a second preferred embodiment the block(s) or wedge-shaped, ramp-like mount(s) are removable and are designed for retrofit to existing marine propulsion units or motors, wherein the block(s), wedge(s) or ramp(s) are attached to the propulsion units or motors by means of one or more clamps such as hose clamps, and the blade(s) then mounted on the mount(s) for cutting the aquatic vegetation.

BRIEF DESCRIPTION OF THE DRAWINGS

The invention will be better understood by reference to the accompanying drawings, wherein:

FIG. 1 is a perspective view of a first preferred embodiment of the blade system for marine motors of this invention, wherein blade-supporting ramps or wedges are cast with or fixed to the motor housing;

FIG. 2 is a sectional view taken along line 2—2 of a blade and ramp combination illustrated in FIG. 1;

FIG. 3 is a sectional view taken along line 3—3 of the blade and ramp combinations, as well as the motor housing illustrated in FIG. 1;

FIG. 4 is a perspective, exploded view of the blade system illustrated in FIG. 1;

FIG. 5 is a top view of a preferred serrated blade element for use in the blade system illustrated in FIGS. 1–4;

FIG. 6 is a sectional view taken along line 6—6 of the blade element illustrated in FIG. 5, more particularly illustrating a preferred technique for mounting a blade on each corresponding wedge or ramp illustrated in FIGS. 1–4;

DESCRIPTION OF THE PREFERRED EMBODIMENTS

Figure 7:
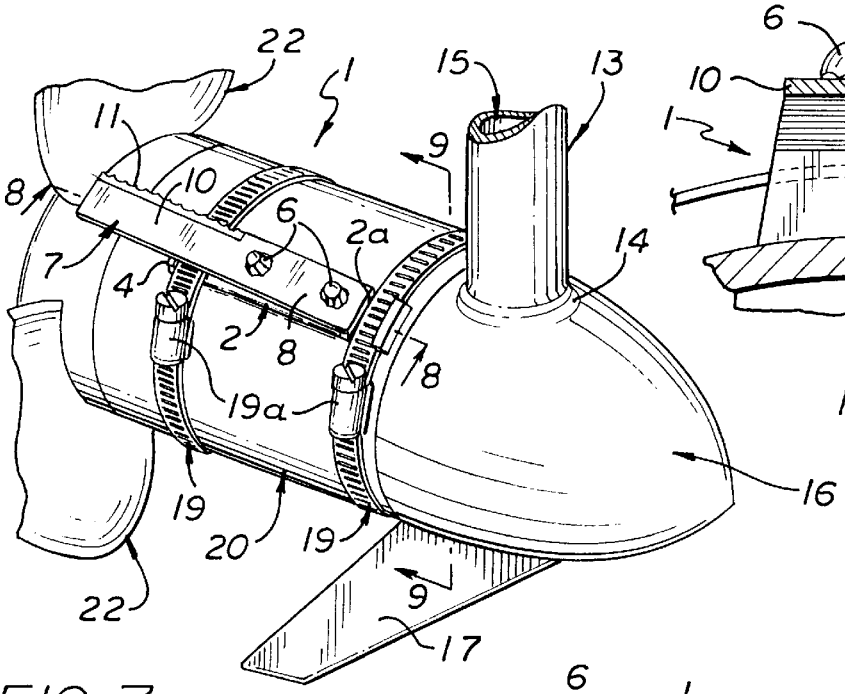
FIG. 7 is a perspective view of a second preferred embodiment of the blade system for marine motors of this invention, wherein blade wedges or ramps are removably mounted in the motor housing.
Figure 10:
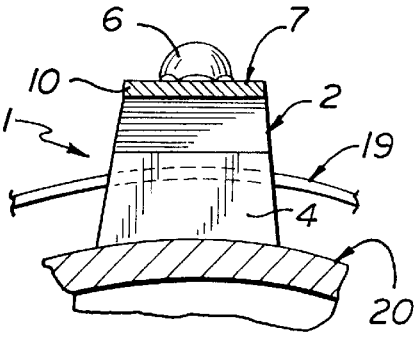
FIG. 10 is a sectional view of the removable ramp and blade element illustrated in FIG. 8.
Figure 8:
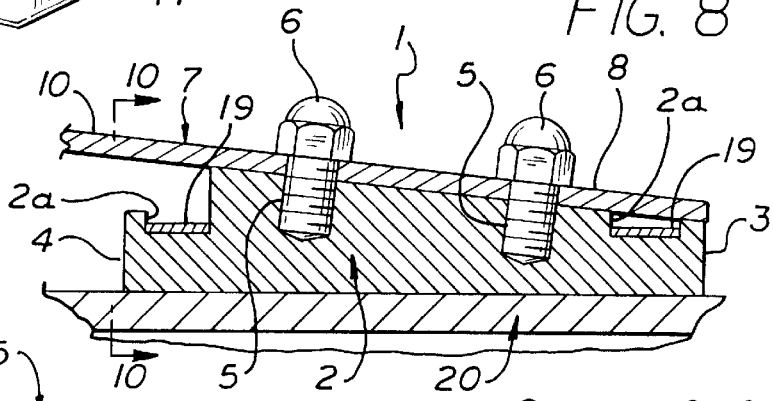
FIG. 8 is a sectional view taken along line 8—8 of the removable ramp and blade elements of the blade system illustrated in FIG. 7.
Figure 9:
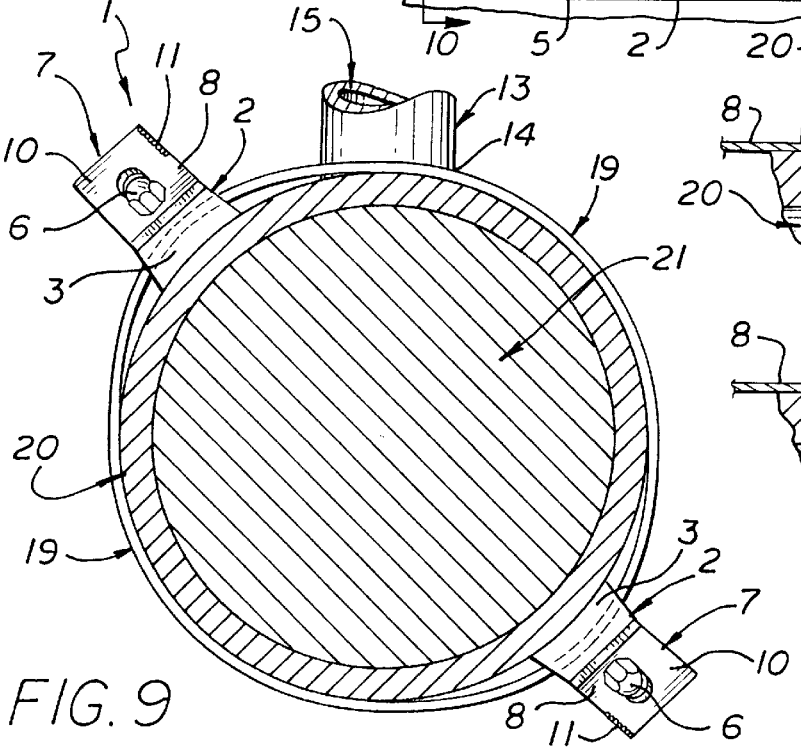
FIG. 9 is a sectional view taken along line 9—9 at the interface of the shaft mount and removable motor housing, more particularly illustrating a preferred mounting of the removable wedge or ramp and blade elements illustrated in FIG. 7.

Referring initially to FIGS. 1–4 of the drawings, in a first preferred embodiment the blade system of this invention is generally illustrated by reference numeral 1. The blade system 1 is characterized by multiple, ramp or wedge-shaped blade mounts 2, which are typically molded in, cast or permanently fixed to the motor housing 20 of a marine outboard motor 23. The outboard motor 23 illustrated in FIGS. 1–4 of the drawings is typically an electric trolling motor and is characterized by a conventional submersible and removable motor housing 20, which is attached in water-sealing relationship to a conventional forward shaft mount 16, that receives a conventional motor mount shaft 13, typically by means of a shaft weld 14. The motor mount shaft 13 is further characterized by a shaft bore 15, through which suitable wiring (not illustrated) extends, in order to connect the drive motor 21, located inside the motor housing 20 (FIG. 3), with a suitable control system (also not illustrated). A propeller 22 is mounted on a shaft (not illustrated) which projects from the rear of the drive motor 21 and is sealed in the motor housing 20 by suitable techniques known to those skilled in the art. Accordingly, as the propeller 22 is driven and rotated by the drive motor 21 in the direction indicated by the curved rear arrow in FIG. 1, a forward force is generated, thrusting the shaft mount 16 and the entire lower unit of the outboard motor 23 forwardly along with the boat (not illustrated) to which it is attached, as illustrated by the front arrow in FIG. 1.

The wedge-shaped blade mounts 2 may be cast or otherwise shaped integrally with the motor housing 20 or fixed thereto in selected numbers and in a desired spacial relationship, typically at the 30-degree, 150-degree, 210-degree and 330-degree mark, using the motor shaft 13 as a base or compass reference point of 360-degrees. This spacing of the blade mounts 2 facilitates adequate clearance of the corresponding blades 7, when the retractible marine motors are retracted on the deck of a boat (not illustrated). However, fewer or more blade mounts 2 may be utilized in the blade system 1, as hereinafter further described.

As further illustrated in FIGS. 5 and 6, each of the blade mounts 2 is fitted with a blade 7, preferably having a cutting segment 10 extending from a blade shank 8, wherein the cutting segment 10 is fitted with a knife edge or, most preferably, serrations 11. In a most preferred embodiment of the invention, and as further illustrated in FIGS. 1, 4, 5 and 6 of the drawings, the respective blade shanks 8 of each of the blades 7 are fitted with shank openings or slots 9 for receiving corresponding fasteners such as bolts 6, (FIG. 1) threaded into correspondingly threaded openings 5 (FIG. 4) in each of the blade mounts 2.

In another preferred embodiment of the invention each of the blade mounts 2 is characterized by a heel portion 3, which tapers upwardly along the blade-receiving surface of the blade mounts 2 and above the plane of the motor housing 20, to a toe portion 4. Consequently, as illustrated in FIG. 2, each of the blades 7, as mounted on a corresponding blade mount 2, extends upwardly and radially outwardly of the motor housing 20, toward the propeller 22. In a most preferred aspect of this embodiment of the invention the ends of each of the cutting segments 10 of the blades 7 terminate about one-half inch from the rotational plane of the leading edge of the propeller 22, but may be adjustable in this respect by operation of the shank openings 9, illustrated in FIGS. 5 and 6. Furthermore, in another preferred embodiment of the invention each end of the respective cutting segments 10 of the blade 7 projects radially from about ¾ of an inch to about 1 inch from the motor housing 20 for optimum cutting of aquatic vegetation (not illustrated) which would normally entangle the motor housing 20, shaft mount 16 and propeller 22, as the propeller 22 rotates in the direction of the rear arrow illustrated in FIG. 1. The aquatic vegetation is cut as the rotating propeller forces the vegetation strands against the serrations 11 in the fixed blades 7.

Referring now to FIGS. 7–10 of the drawings in another preferred embodiment of the invention the blade mounts 2 are characterized by removable ramps, wedges or mounts 2, which are preferably fitted with a pair of mount slots 2*a* at the extending ends thereof, in order to accommodate a pair of corresponding slotted mount bands 19, fitted with band screws 19*a* and commonly known as "hose clamps". Accordingly, a selected number of blade mounts 2 can be spaced in a desired position or positions radially around the circumference of the motor housing 20, typically in the locations illustrated in FIGS. 7 and 9. The blades 7 typically have the configuration illustrated in FIGS. 5 and 6, previously discussed, and are attached to the respective blade mounts 2 by means of fasteners 6, in the same manner as detailed above with respect to the first embodiment of the invention. The removable blade mount embodiment of the invention faciliates retrofitting of the blade system 1 of this invention to the propulsion units (not illustrated) of existing outboard motors 23 and existing electric trolling motors in particular, with the additional facility of adjusting any desired number of blade mounts 2 into any desired radial relationship with respect to the motor mount shaft 13. For example, four such blade mounts 2 may be mounted to the motor housing 20 using the respective mount bands 19, such that the blade mounts 2 are disposed in the 30-degree, 150-degree, 210-degree and 330-degree configuration, measured from the 360-degree fixed position of the motor mount shaft 13, as illustrated in FIG. 3 of the drawings with respect to the fixed blade mount embodiment. Alternatively, referring to FIGS. 7 and 9, respectively, one or a pair of such blade mounts 2 can be positioned typically, but not necessarily, in approximately the 150-degree and the 150-degree and 330-degree positions, respectively, with respect to the motor shaft 13 at the 360-degree mark, as desired. Consequently, experimentation with the application of one or more of the blade mounts 2 and blades 7 on the propulsion unit of any particular outboard motor 23 may be easily conducted with the retrofit embodiment illustrated in FIGS. 7–9 and the ideal or optimum spacing and number of blade mounts 2 and corresponding blades 7 for cutting the aquatic vegetation may change, depending upon the motor horsepower and design, as well as the size of the propeller of the respective outboard motor 23 under c consideration and the nature of the aquatic vegetation in the waterbody.

Figure 11:
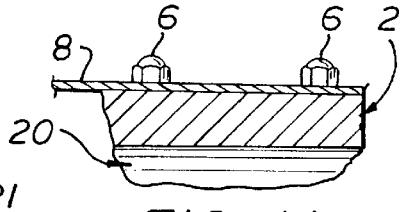
FIG. 11 is a sectional view of an alternative preferred embodiment wherein the blade mount is a rectangular block and the blade element is bolted to the blade mount.
Figure 12:
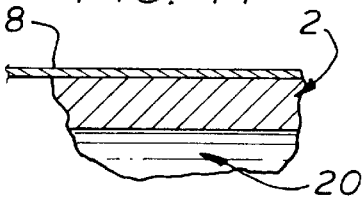
FIG. 12 is a sectional view of the blade mount and blade element illustrated in FIG. 11, wherein the blade element is fixed to the blade mount and the blade mount is glued or otherwise fixed to the motor housing.

Referring now to FIG. 11 of the drawings, a blade or blades 7 may be bolted to one or more rectangular blade mounts 2, which are each spaced from the motor housing 20 a desired distance, according to the thickness of the rectangular blade mount 2. Furthermore, as illustrated in FIG. 12, each blade 7 may be glued, welded or otherwise permanently fixed to the underlying rectangular blade mount 2, as desired. Moreover, the blade mount(s) 2 may be permanently fixed or clamped to the motor housing 20, as described above. Still further in the alternative, the blade shank or shanks 8 of one or more blades 7 may be glued, bolted, clamped or otherwise attached directly to the motor housing 20, although the cutting efficiency of the blades 7 increases when the blades 7 are attached to or mounted on the respective blade mounts 2.

It will be appreciated by those skilled in the art that both the fixed and removable blade mount 2 embodiments and variations of the blade system 1 of this invention may be utilized on the propulsion unit of substantially any marine outboard motor currently in production. As a practical matter, the propulsion units of outboard motors having a relative small horsepower and electric trolling motors in particular, are more susceptible to application of the blade system 1 of this invention, since these motors are so often used in shallow water where hydrilla and other aquatic vegetation typically grows. However, the blade system of this invention, in all variations, may also be used on larger outboard motors, in order to prevent, or at least minimize, entanglement of this vegetation with the motor and/or propeller, under circumstances where the boat is moved from deep water into shallow water to approach a fishing area and while leaving the fishing area. These larger motors are then typically retracted such that the lower units clear the water, while a smaller motor such as an electric trolling motor, is used to traverse the area for fishing or other purposes. Accordingly, a very broad application for the various embodiments of the blade system 1 of this invention, whether it be the removable or fixed blade mount embodiment, is to electric trolling motors which can be used in extremely shallow water to propel the boat or watercraft at slow speeds while fishing or for other purposes.

It will be further appreciated by those skilled in the art that various techniques can be utilized for mounting the respective blades 7 on the fixed or removable blade mounts 2, respectively, according to the knowledge of those skilled in the art. The fasteners 6 are typically bolts which may have projecting heads as illustrated in the drawings, or may be countersunk into the plane of the respective blade shanks 8, as desired. Furthermore, the shank openings 9 may be longitudinally slotted to facilitate adjustment of the extending ends of the cutting segments 10 of the blade 7 closer or farther away from the propeller 22, as desired and as illustrated in FIGS. 5 and 6. Moreover, the design and number of blades 7 may be altered according to the knowledge of those skilled in the art, although blades 7 having cutting segments 10 provided with serrations 11, has proved to be a very effective blade design for use in the blade system 1 of this invention.

Referring again to the drawings, it will be appreciated that the size and shape of the blade mounts 2 may vary, although a typical length is about three inches and the width may be about ¾ of an inch. A typical incline in the wedge or ramp-type blade mounts 2 is characterized by a heel portion 3 of about ¼ of an inch and a toe portion of about ½ of an inch. Alternatively, it will be recognized that the blade mounts 2 may be substantially rectangular blocks instead of wedge-shaped, as illustrated in FIGS. 11 and 12 and the rectangular blade mounts 2 are sufficiently thick to separate the blades 7 from the motor housing 20 a desired distance, typically from about ¾ of an inch to about 1 inch.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A blade system for cutting aquatic vegetation encountered by a marine motor, said blade system comprising at least one substantially wedged-shaped ramp provided on the marine motor and an elongated blade having a shank carried by said ramp and a cutting edge extending from said shank for cutting the aquatic vegetation.

2. The blade system of claim 1 wherein said at least one substantially wedge-shaped ramp comprises a plurality of substantially wedge-shaped ramps disposed on the marine motor in spaced relationship with respect to each other and said blade comprises a blade carried by each of said substantially wedge-shaped ramps.

3. The blade system of claim 2 comprising fastening means engaging said blade and said substantially wedge-shaped ramps respectively, for removably securing said blade to said substantially wedge-shaped ramps, respectively.

4. The blade system of claim 1 comprising fastening means engaging said shank of said blade and said ramp for removably securing said blade to said ramp.

5. The blade system of claim 1 wherein said at least one substantially wedge-shaped ramp comprises a plurality of substantially wedge-shaped ramps disposed on the marine motor in radially spaced relationship with respect to each other and said cutting edge of said blade comprises a serrated cutting edge extending from said shank for cutting the aquatic vegetation.

6. The blade system of claim 5 comprising fastening means engaging said shank of said blade and said ramps, respectively, for removably securing said blade to said ramps, respectively.

7. The blade system of claim 1 comprising clamp means for engaging said ramp and the marine motor for securing said ramp to the marine motor.

8. The blade system of claim 7 wherein said ramp comprises at least one block and comprising at least one groove or slot provided in said block for receiving said clamp means.

9. The blade system of claim 7 wherein said at least one wedge-shaped ramp comprises a plurality of substantially wedge-shaped ramps positioned on said marine motor in radially spaced relationship with respect to each other, and comprising at least one groove or slot provided in each of said ramps for receiving said clamp means.

10. The blade system of claim 9 comprising first fastening means engaging said blade for removably securing said blade to said ramps and clamp means engaging the marine motor and said groove or slot in said ramps, for removably securing said, ramps to the marine motor.

11. The blade system of claim 1 wherein said at least one substantially wedge-shaped ramp is integrally formed or shaped with the marine motor.

12. The blade system of claim 11 wherein said at least one substantially wedge-shaped ramp comprises a plurality of substantially wedge-shaped ramps defined on the marine motor in radially-spaced relationship with respect to each other and said elongated blade comprises an elongated blade having a shank carried by each of said ramps, respectively.

13. The blade system of claim 12 comprising fastening means engaging said blade and said ramps, respectively, for removably securing said blade to said ramps, respectively.

14. A blade system for mounting on an electric marine motor having a propeller and cutting aquatic vegetation encountered by the electric marine motor and the propeller, said blade system comprising at least one blade mount provided on the electric marine motor, said blade mount having a bevelled blade-receiving surface; clamp means engaging said blade mount and the electric marine motor for removably securing said blade mount on the electric marine motor; and a blade seated on said bevelled blade-receiving surface of said blade mount, said blade extending toward the propeller for cutting the aquatic vegetation responsive to operation of the electric marine motor and rotation of the propeller.

15. The blade system of claim 14 wherein said at least one blade mount comprises a plurality of substantially wedge-shaped ramps positioned on the marine motor in spaced relationship with respect to each other and further comprising a pair of slots provided in each of said ramps for receiving said clamp means and fastening means engaging said blade and said ramps for removably securing said blade to said ramps, respectively.

16. A blade system for mounting on an electric marine motor having a propeller and cutting aquatic vegetation encountered by the electric marine motor and the propeller, said blade system comprising at least one blade mount provided on the electric marine motor, said blade mount having a blade-receiving surface spaced from the electric marine motor and substantially parallel to the electric marine motor and a blade provided on said blade-receiving surface of said blade mount, said blade extending toward the propeller for cutting the aquatic vegetation responsive to operation of the electric marine motor and rotation of the propeller.

17. The blade system of claim 16 wherein said at least one blade mount comprises a plurality of blade mounts oriented on the electric marine motor in spaced relationship with respect to each other, whereby said blade extends from said blade mounts, respectively.

18. The blade system of claim 17 comprising fastening means engaging said blade and said blade mounts, respectively, for removably securing said blade on said blade mounts, respectively.

* * * * *